United States Patent [19]

Bissonnette

[11] Patent Number: 4,848,210

[45] Date of Patent: Jul. 18, 1989

[54] ELASTOMERIC IMPULSE ENERGY STORAGE AND TRANSFER SYSTEM

[75] Inventor: Laurent C. Bissonnette, Narragansett, R.I.

[73] Assignee: The United States of America as represented by the Secretary of the Navy, Washington, D.C.

[21] Appl. No.: 70,841

[22] Filed: Jul. 1, 1987

[51] Int. Cl.[4] ..... F41F 3/08

[52] U.S. Cl. ..... 89/1.810; 114/238; 114/319; 124/70

[58] Field of Search ..... 114/238, 318, 319; 89/1.809, 1.810; 42/1.14; 124/69, 71, 73, 70

[56] References Cited

U.S. PATENT DOCUMENTS

| | | | |
|---|---|---|---|
| 2,546,961 | 4/1951 | Amero | 114/238 |
| 2,900,972 | 8/1959 | Marsh et al. | 42/1.14 X |
| 3,075,301 | 1/1963 | Fiedler et al. | 89/1.810 X |
| 3,183,904 | 5/1965 | Barakauskas | 114/238 X |
| 3,298,278 | 1/1967 | Barakauskas | 89/1.810 X |
| 3,516,380 | 6/1970 | Johnston | 114/238 |
| 4,523,538 | 6/1985 | Hollmann et al. | 114/238 |

*Primary Examiner*—David H. Brown

*Attorney, Agent, or Firm*—Arthur A. McGill; Michael J. McGowan; Prithvi C. Lall

[57] ABSTRACT

A device for storing potential energy in the form of a distended elastomeric bladder and rapidly converting that stored energy into kinetic energy of a working fluid for quietly ejecting a projectile from the device into the surrounding fluid medium.

6 Claims, 1 Drawing Sheet

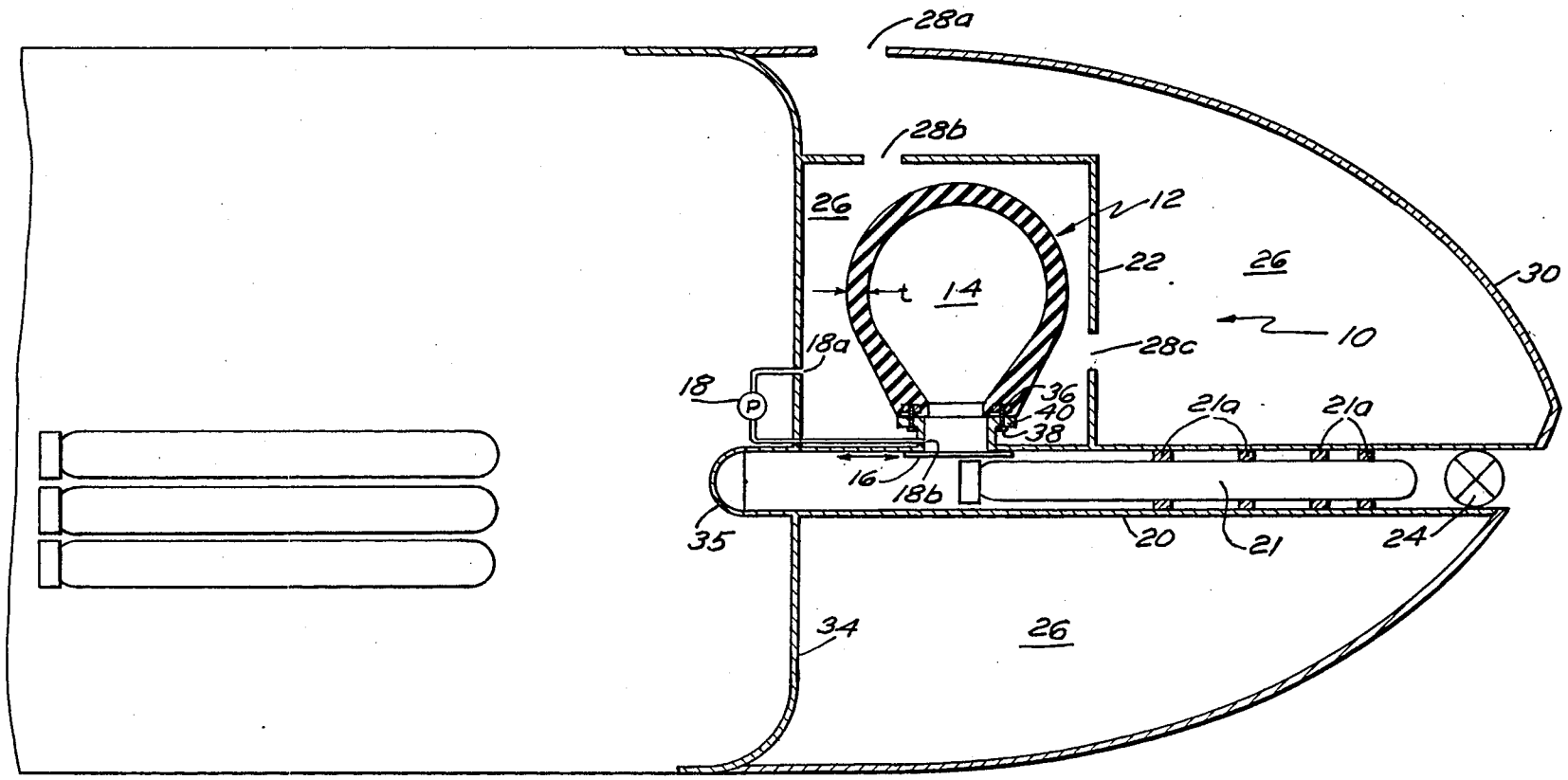
30
28a
28b
26
12
22
28c
10
26
21a
21a
24
21
20
26
36
40
38
14
t
18b
16
18a
18
P
35
34

ELASTOMERIC IMPULSE ENERGY STORAGE AND TRANSFER SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to projectile launching devices and more particularly to an energy storage and low-noise launch system using an elastomeric bladder as the energy storage medium.

(2) Description of the Prior Art

Present means of rapidly converting potential energy of a working fluid into kinetic energy of a projectile launched along with such fluid are either ram pump or turbine pump based ejection systems. Such systems are mechanically complex and thus tend to radiate noise into the surrounding fluid medium.

A ram pump type of energy storage and conversion system converts the potential energy of compressed air stored in a flask into kinetic energy of a mechanical piston assembly, which assembly in turn transfers this kinetic energy to the working fluid in contact with the piston. Such a system, however, requires a comparatively massive piston assembly in order to transfer sufficient kinetic energy to the working fluid to launch the projectile. Further, mechanical friction together with the mass of the piston assembly act to reduce system efficiency and to produce substantial radiated noise. The ram pump system also includes numerous other mechanical components, in addition to the piston assembly, which require frequent maintenance.

A turbine pump energy storage and transfer system converts the potential energy of compressed air stored in a flask into kinetic energy of a working fluid via the cooperative action of three major components; an air turbine, a speed reduction unit, and a rotary impeller pump. Such a system further requires a complex high-speed air-turbine drive unit, and a complex, low cavitation impeller pump design. The turbine pump system is thus costly due to the complexity of the required mechanical components and is also quite noisy due to dynamic interaction of many of the system components. In addition, overall system efficiency is quite low due to the combined mechanical losses of these three major components.

SUMMARY OF THE INVENTION

Accordingly, it is a general purpose and object of the present invention to provide an improved, impulse energy storage and transfer system. It is a further object that, in operation, such system emit a low level of radiated noise. Another object is that this system exhibit a relatively high mechanical efficiency. Still another object is that the system be simple, reliable and low in cost. A still further object is that such system employ an elastomeric energy storage means.

These objects are accomplished with the present invention by providing, in combination, a device for storing potential energy in the form of a distended, fluid medium filled, elastomeric bladder and rapidly converting that stored energy into kinetic energy of the working fluid for quietly ejecting a projectile along with the stored fluid from the device and into the surrounding fluid medium.

BRIEF DESCRIPTION OF THE DRAWINGS

A more complete understanding of the invention and many of the attendant advantages thereto will be readily appreciated as the same becomes better understood by reference to the following detailed description when considered in conjunction with the single accompanying drawing wherein there is shown an elastomeric impulse energy storage and transfer system according to the present invention.

DESCRIPTION OF THE PREFERRED EMBODIMENT

The present invention stores potential energy in the form of a distended, fluid filled, elastomeric bladder and rapidly and quietly converts that energy into kinetic energy of the stored working fluid as it flows through a tubular launch tube enclosing a projectile. The moving fluid acts to expel the projectile entrained therein. Such an energy storage and transfer system is particularly well suited for, but not limited to, submarine launcher system applications.

Referring now to the drawing there is shown a submarine launcher system 10. System 10 employs the teachings of the present invention to provide the energy required to quietly launch a projectile, such as a torpedo, from a submarine. It is noted that while the drawing schematically shows a single launching tube, it is understood that bladder 12 may be connected to a plurality of such tubes by using well known submarine piping and valving arrangements to direct the ejecting fluid to a preselected tube. System 10 comprises an elastomeric bladder 12 which forms an enclosed bladder volume 14, a flow controlling exit valve 16, a positive displacement pump 18 for providing pressurized liquid to expand volume 14 of elastomeric bladder 12, and a cylindrical launch tube 20 for slidably housing a cylindrical projectile 21 on slidable chocks **21*a* and directing the stored working fluid therethrough. Valve 16 is located along tube 20 such that the ejected fluid is directed behind projectile 21. System 10 further includes a bladder protecting support structure 22 surrounding bladder 12, a muzzle valve 24 at the launch end of tube 20, a generally free flood volume 26 within outer hull 30 and inside and outside structure 22 thus permitting outside sea water to surround bladder 12 by means of inlet 28*a* in outer submarine hull 30 and inlets 28*b* and c in support structure 22. Structure 22 provides protection for bladder 12 from the potentially damaging effects of shock and vibration. While the sea water outside hull 30 and in free flood volume 26 is not shown, it is understood that such fluid fills volume 26 and is at a pressure commensurate with submarine depth. Tube 20 is oriented at an angle so as to sealably pass through pressure resisting hull 34 at joint 34*a*. The angle is selected based on desired tube aim direction relative to pressure hull shape. A breach door 35 is provided at the end of tube 20 extending inside pressure hull 34**.

The shape, diameter, wall thickness "t" and material properties of generally spherical bladder 12 are selected to deliver a specific desired impulse profile. Such paramters are determined using general principles of the mechanical design arts from the theory of elasticity, elastic membrane theory, and fluid dynamics. An elastomeric material thus chosen for bladder 12 has the ability to store sufficient energy to provide the required impulse when permitted to contract. Suitable materials include a Neoprene rubber, a urethene or similar elastomeric materials.

In operation, system 10 functions as follows. Elastomeric impulse bladder 12 is first pressurized with working fluid such as seawater via pump 18 located within pressure hull 34. Pump 18 has an inlet pipe to provide a sea water suction port 18*a* through pressure hull 34 and an outlet pipe passing back through hull 34 and into volume 26. Pump 18, which is preferably of a positive displacement type, thus inflates bladder 12 with sea water. The energy used by pump 18 to pressurize bladder 12 is, at this point, stored by the elongation of the distended elastic walls of bladder 12. Bladder 12 behaves in similar fashion to a capacitor by undergoing a slow buildup of stored energy while providing the capability of controlled rapid discharge. The discharge rate is a function of the dynamic elastic modulus of the selected material, bladder geometry and general hydraulic system discharge losses. When the energy stored in the bladder is required for launching a projectile, muzzle valve 24 and then exit valve 16 are opened to permit bladder 12 to contract and thereby discharge the working fluid and projectile 21. The contraction of the bladder rapidly converts the stored potential energy to propulsive kinetic energy of the stored fluid at the desired conversion rate.

Elastomeric bladder 12 and support structure 22 being located in the free flood volume 26 of the submarine ensures that system 10 remains pressure balanced thus automatically compensating for depth changes. Water inlets 28*a*, 28*b* and 28*c* are provided in outer submarine hull 30 and in support structure 22 respectively to ensure sufficient water flow around elastomeric bladder 12 during contraction. Such water flow is needed to permit rapid contraction of bladder 12. Launch tube 20 directs the moving fluid from volume 14 and also guides and slidably supports projectile 21. Tube 20 is located outside pressure hull 34 for the most part. Positive displacement pump 18 provides the energy which the bladder stores for rapid discharge at time of projectile launch. The energy may be slowly and quietly transferred from pump 18 to bladder 12 in the form of pressurized seawater. Pump 18 suctions fluid from free flood area 26 via port 18*a* and discharges to volume 14 of bladder 12 via port 18*b*. Slide valve 16 controls system 10 operation. In the closed position valve 16 permits bladder filling and then prevents elastomeric bladder 12 from discharging. In the open position valve 16 connects elastomeric bladder 12 to the breach end of launch tube 20 releasing the pressurized seawater and allowing it to force projectile 21 from tube 20.

The normal state of the system is with launch tube 20 loaded and elastomeric bladder 12 pressurized with seawater. It is noted that the free state volume 14 of bladder 12 must be increased by at least one launch tube volume in the pressurized state in order to store sufficient energy for projectile launch. Upon initiation of a launch sequence, tube 20 floods with seawater and equalizes internal tube pressure with ambient sea pressure. Muzzle valve 24 then opens. Valves and piping used to perform launch tube flooding are well known in the submarine launch art and therefore are not included in the drawing. Slide valve 16 then rapidly opens allowing elastomeric bladder 12 to contract thereby discharging the stored seawater behind projectile 21 and, together with projectile 21, it discharges from tube 20. Muzzle valve 24 and slide valve 16 then close. Launch tube 20 next begins to vent and drain. Piping for the vent and drain cycle are also well known in the submarine launch tube art and therefore are not illustrated. Concurrently with commencement of venting and draining operations, positive displacement pump 18 begins to expand elastomeric bladder 12 with pressurized sea water for the next firing. The positive displacement pump therefore has sufficient time to slowly recharge bladder 12 for the next firing during venting, draining, and also during projectile reloading operations.

Bladder 12 may be fabricated together with an embedded metal attachment ring 36 to form a molded assembly. Bladder 12 and ring 36 may then be secured to exit valve 16 by means of a plurality of bolts 38 through flange 40 of tube 20. Flange 40 also receives the output pipe of pump 18 and by means of port 18b provides accesss to volume 14 for the pressurized sea water.

The advantages of this invention include: A significant noise reduction during system operation by elimination of high speed mechanical components and by inclusion of the vibration damping properties of viscoelastic bladder 12; Improved system efficiency by directly and efficiently storing and converting energy and efficiently delivering a desired impulse; A significant cost reduction achieved by eliminating complex and costly mechanical components; A reduction in space and weight over present ejection systems; and Elimination of large pressure hull 34 ejection pump penetrations.

New features of system 10 include, use of elastomeric potential energy storage, direct conversion of potential energy into fluid kinetic energy without intermediate mechanical components and hence low noise, efficient use of free flood space and greatly reduced radiated noise into the surrounding fluid medium.

What has thus been described is a device for storing potential energy in the form of a distended elastomeric bladder and rapidly converting that stored energy to kinetic energy of a working fluid for quietly launching a projectile from a launch tube into a fluid medium.

Obviously many modifications and variations of the present invention may become apparent in light of the above teachings. For example: The invention may be utilized in many separate system configurations as long as each includes an elastomeric bladder formed from any material whose elastic properties yield the desired impulse, a fluid pump (positive displacement, centrifugal or otherwise) which is used to pressurize the bladder, and an exit valve of any design (such as a slide valve type) that may be selectively used to retain and release the working fluid from the bladder. The invention may thus be used to provide an improved spear gun for underwater fishing use where the quiet launch properties of the elastomeric bladder serve to mask the noise of launching the fish piercing/holding projectile. Further, the fishing projectile itself need no longer have a long shaft as present spears must in order to provide sufficiently long rubber band stretch. It is noted that such a spear gun application for the present invention does not require the presence of a pressure hull.

In light of the above, it is therefore understood that within the scope of the appended claims, the invention may be practiced otherwise than as specifically described.

What is claimed is:

1. An apparatus for ejecting cylindrical projectiles into a liquid medium, comprising:

at least one cylindrical launch tube, each said tube having a longitudinal axis, a muzzle end, a breach end and an internal diameter greater then the diameter of said projectile, for housing said projectile and slidably guiding said projectile during said ejection;

breach valve means, one each fixedly attached to said breach end of each said launch tube, for providing access to the interior volume of each said launch tube from said breach end for loading said projectiles;

muzzle valve means, one each fixedly attached to the muzzle end of each said launch tube, for providing egress for said projectiles from each said launch tube into said liquid medium;

cylindrical flange means, one each fixedly attached to each said launch tube between said muzzle end and said breach end, being located nearer to said breach end of said tube so as to be positioned behind said projectile, said flange means having a longitudinal axis oriented generally orthagonally with respect to said longitudinal axis of said launch tube, for providing access to each said launch tube internal volume at a point behind said projectile;

control valve means, one each fixedly attached to each said flange means, for selectively connecting each said flange means to its corresponding tube volume;

elastomeric bladder means, fixedly attached to each said flange means, said bladder means being generally spherical in shape and having a wall thickness "t", for storing energy by elastic expansion of said wall thereof, the exterior surface of said bladder means being exposed to the pressure of said liquid medium; and pump means, having a suction side and a discharge side, the suction side thereof being connected to said liquid medium and the discharge side thereof being connected to the interior volume of said bladder means via said flange means, for selectively pumping said liquid into the interior volume of said bladder thereby inflating said bladder means and distending said bladder wall;

whereby, upon opening of said muzzle valve means thereby flooding said launch tube and then opening said control valve means thereby connecting said bladder internal volume, via said flange means, to said launch tube volume, said bladder contracts thereby forcing the liquid medium stored therein through said flange means and out of said muzzle end of said launch tube along with said projectile.

2. An apparatus according to claim 1 further comprising a pressure hull separating a higher pressure liquid medium from a lower pressure gaseous medium, each said tube being fixedly attached through said pressure hull, each said breach valve being on the gaseous side of said hull and each said cylindrical flange being on the liquid medium side of said pressure hull.

3. An apparatus according to claim 2 wherein said elastomeric bladder means further comprises:

an elastomer bladder;

a circular metal attachment ring, embedded in said bladder, for permitting securing of said bladder to said flange means; and a plurality of fasteners for securing said metal ring and said bladder to said flange means.

4. An apparatus according to claim 3 further comprising a metal support structure having an internal volume and shape selected to be greater than the volume occupied by said bladder in its expanded state for providing protection to said bladder from the effects of shock and vibration, said support structure having a plurality of aperatures passing therethrough to permit free passage of said liquid medium.

5. An apparatus according to claim 4 wherein said bladder is of Neoprene rubber material.

6. An apparatus according to claim 4 wherein said bladder is of urethane rubber material.

* * * * *